US010556712B2

(12) United States Patent
Wolf et al.

(10) Patent No.: US 10,556,712 B2
(45) Date of Patent: Feb. 11, 2020

(54) METHOD AND DEVICE FOR SEPARATING AND TRANSFERRING PELLETS

(71) Applicant: Harro Hoefliger Verpackungsmaschinen GmbH, Allmersbach im Tal (DE)

(72) Inventors: Achim Wolf, Weissach im Tal (DE); Stefan Wolf, Backnang (DE); Karlheinz Seyfang, Weissach im Tal (DE)

(73) Assignee: Harro Hoefliger Verpackungsmaschinen GmbH, Allmersbach im Tal (DE)

( * ) Notice: Subject to any disclaimer, the term of this patent is extended or adjusted under 35 U.S.C. 154(b) by 0 days.

(21) Appl. No.: 15/874,732

(22) Filed: Jan. 18, 2018

(65) Prior Publication Data

US 2018/0141689 A1 May 24, 2018

Related U.S. Application Data

(63) Continuation of application No. PCT/EP2015/001484, filed on Jul. 18, 2015.

(51) Int. Cl.
*B65B 37/16* (2006.01)
*B65B 37/14* (2006.01)

(52) U.S. Cl.
CPC ..... *B65B 37/16* (2013.01); *B65B 37/14* (2013.01)

(58) Field of Classification Search
CPC ..... B65B 37/16; B65B 83/0409; B65B 65/46; B65B 75/38; B65B 75/52; B65B 85/62; B65D 75/38; B65D 75/52; B65D 85/62
(Continued)

(56) References Cited

U.S. PATENT DOCUMENTS 604,315 A * 5/1898 Green ..... G07F 5/24 453/43
1,383,623 A * 7/1921 Groves ..... B65B 5/103 53/493
(Continued)

FOREIGN PATENT DOCUMENTS

CN 1674854 A 9/2005
CN 101795723 A 8/2010
(Continued)

OTHER PUBLICATIONS

International Search Report dated Feb. 11, 2016 of international application PCT/EP2015/001484 on which this application is based.

*Primary Examiner* — Rakesh Kumar
(74) *Attorney, Agent, or Firm* — Walter Ottesen, P.A.

(57) ABSTRACT

A pellet column is formed in a metering duct. The lowermost pellet is located in a connection point where an outlet duct is connected to the metering duct and leads transversely away therefrom. A first duct, which opens into the metering duct via a first duct mouth above the connection point, is impinged with negative pressure, wherein a pellet is suctioned onto the first duct mouth and is fixed thereto. This pellet acts as a block for the pellets thereabove. A second duct, which opens into the connection point via a second duct mouth, is impinged with positive pressure, wherein the pellet at the connection point is pneumatically ejected via the outlet duct and supplied to a container. After the ejection of the lowermost pellet, the negative pressure in the first duct is switched off such that the pellet held at the first duct mouth advances toward the connection point.

7 Claims, 5 Drawing Sheets

(58) Field of Classification Search
USPC ..... 221/1
See application file for complete search history.

(56) References Cited

U.S. PATENT DOCUMENTS 2,657,812 A * 11/1953 Fox ..... B65G 47/1407 221/252
3,118,564 A * 1/1964 Vokes ..... B65G 47/1407 221/1
3,346,305 A * 10/1967 Heymann ..... B65G 47/1407 406/137
3,410,452 A * 11/1968 Igel ..... B65G 15/42 221/13
3,542,185 A * 11/1970 Geyer ..... B65G 47/1421 406/47
3,612,271 A 10/1971 Behling
3,625,570 A * 12/1971 Ford ..... B65G 47/1407 406/137
3,679,097 A * 7/1972 Gunter ..... B65G 47/1407 221/163
3,775,941 A * 12/1973 Bross ..... B65B 5/103 53/246
4,035,029 A * 7/1977 Lindstrom ..... B65G 47/1407 406/137
4,208,153 A * 6/1980 Trethewy ..... B21J 15/32 221/124
4,214,844 A * 7/1980 Cockayne ..... B65G 47/1407 198/953
4,223,751 A * 9/1980 Ayers ..... B07C 5/16 177/210 C
4,229,125 A * 10/1980 Lindstrom ..... B04C 3/00 198/953
4,231,687 A * 11/1980 Sticht ..... B65G 47/14 198/953
4,270,669 A * 6/1981 Luke ..... B65G 59/103 221/13
4,408,624 A * 10/1983 Friemert ..... H05K 13/02 134/1
4,411,561 A * 10/1983 Carnahan ..... B65G 47/1407 198/953
4,789,519 A * 12/1988 Schoening ..... G21C 1/07 221/299
4,801,044 A * 1/1989 Kubota ..... B65G 47/1407 221/163
4,953,749 A * 9/1990 Kubota ..... B65G 47/1407 221/168
5,000,393 A * 3/1991 Madsen ..... A47K 10/38 221/297
5,080,552 A * 1/1992 Takahashi ..... H01L 21/67126 221/298
5,083,654 A * 1/1992 Nakajima ..... B65G 43/08 198/380
5,111,965 A * 5/1992 Allen ..... B65G 59/062 221/281
5,167,350 A * 12/1992 Amberg ..... C11D 3/08 134/93
5,385,434 A * 1/1995 Quinn ..... B23P 19/003 198/399
5,570,812 A * 11/1996 Ando ..... B65G 47/1407 198/444
5,671,262 A * 9/1997 Boyer ..... G06M 1/101 377/11
5,806,715 A * 9/1998 Hamuro ..... H05K 13/028 141/18
5,809,775 A 9/1998 Tarabulski et al.
5,826,698 A * 10/1998 Sawada ..... B65G 47/1407 198/443
6,116,821 A * 9/2000 Teoh ..... B23P 19/005 406/112
6,513,679 B2 * 2/2003 Greenwald ..... A61J 7/0084 221/287
6,631,826 B2 * 10/2003 Pollard ..... A61J 7/02 221/156
7,007,821 B2 * 3/2006 Aylward ..... B65B 5/103 221/289
7,284,934 B2 * 10/2007 Hoogers ..... H05K 13/027 221/278
7,401,695 B2 * 7/2008 DerMarderosian .... B65G 51/20 198/529
7,770,383 B2 8/2010 Kaefer et al.
7,956,623 B2 * 6/2011 Bassani ..... B65B 5/103 324/663
8,079,456 B1 * 12/2011 Wroblewski ..... B65G 47/1435 198/392
8,291,901 B2 10/2012 Jones et al.
8,376,662 B2 * 2/2013 Suchey ..... E04B 5/29 406/137
8,607,787 B2 12/2013 Jones et al.
8,651,326 B2 * 2/2014 Pollard ..... A61J 7/02 221/278
8,972,049 B2 * 3/2015 Tidhar ..... B65B 5/103 700/236
9,101,531 B1 * 8/2015 Song ..... A61J 7/0472
9,409,227 B2 * 8/2016 Ivo ..... B23P 19/005
9,713,684 B2 7/2017 Jones et al.
9,919,115 B2 3/2018 Jones et al.
10,118,720 B2 * 11/2018 Kim ..... B65B 37/04
2006/0064943 A1 3/2006 Trebbi et al.
2009/0090659 A1 * 4/2009 Monti ..... B65B 5/103 209/528
2012/0006843 A1 * 1/2012 Kim ..... B65B 5/103 221/1
2018/0056460 A1 * 3/2018 Wong ..... B23P 19/004

FOREIGN PATENT DOCUMENTS

EP 1882833 A1 1/2008
JP H0497009 U 8/1992
JP 4094393 B2 3/2008

* cited by examiner

Fig. 2
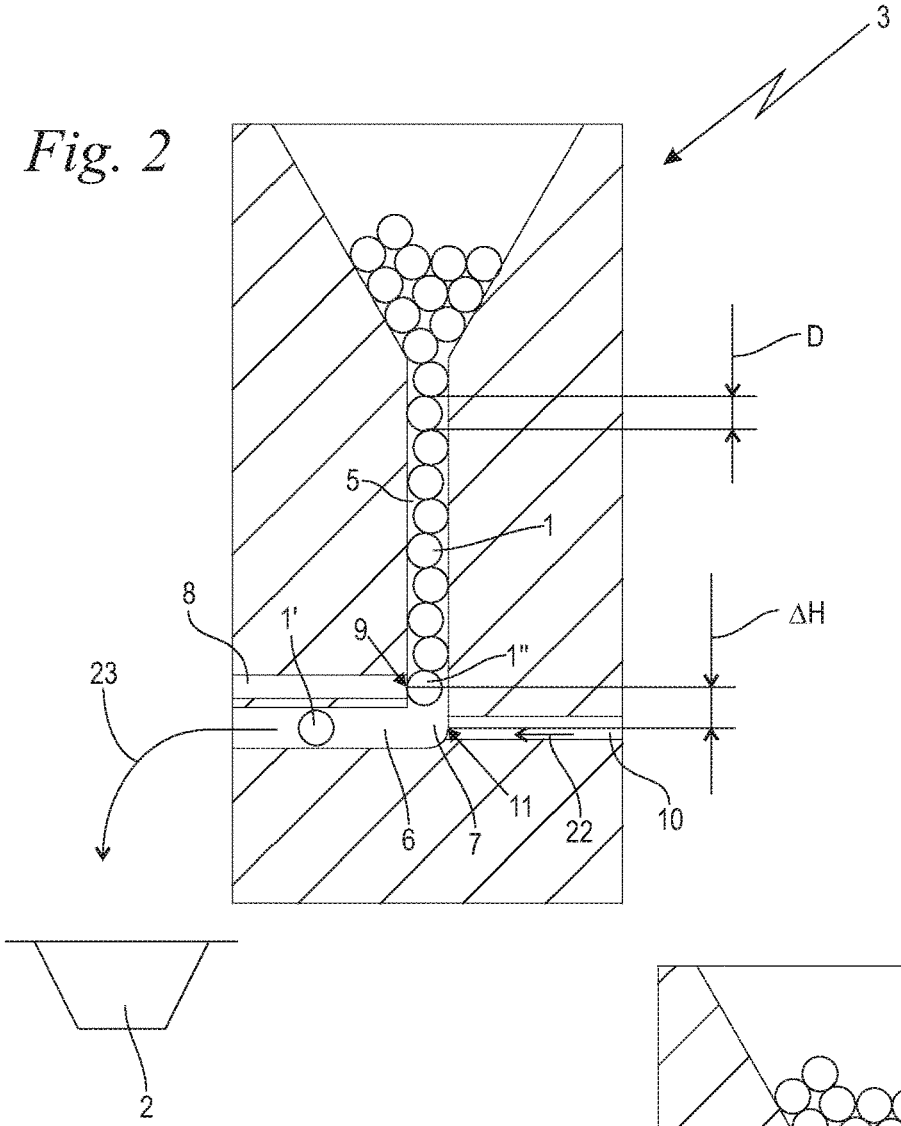
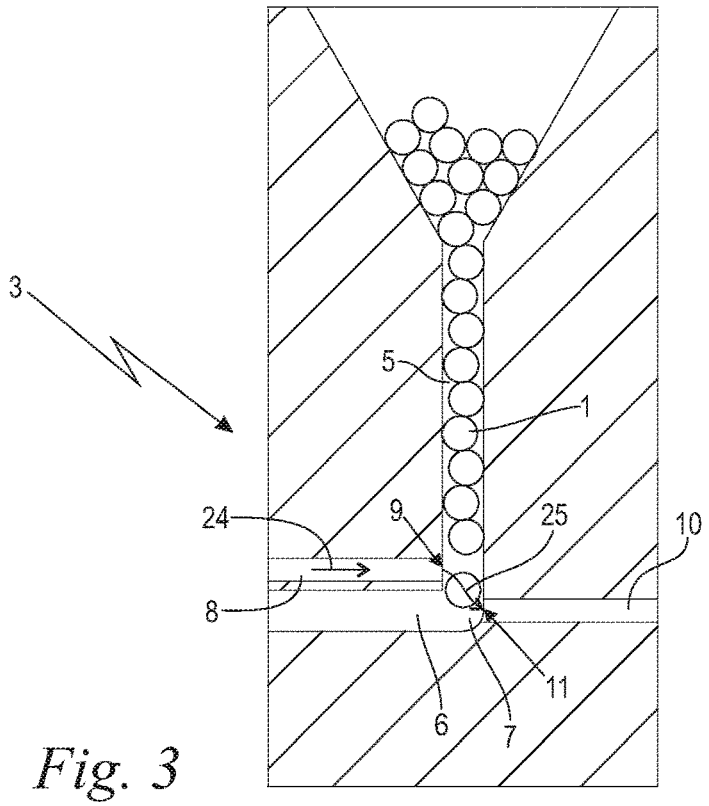
Fig. 3

*Fig. 5*
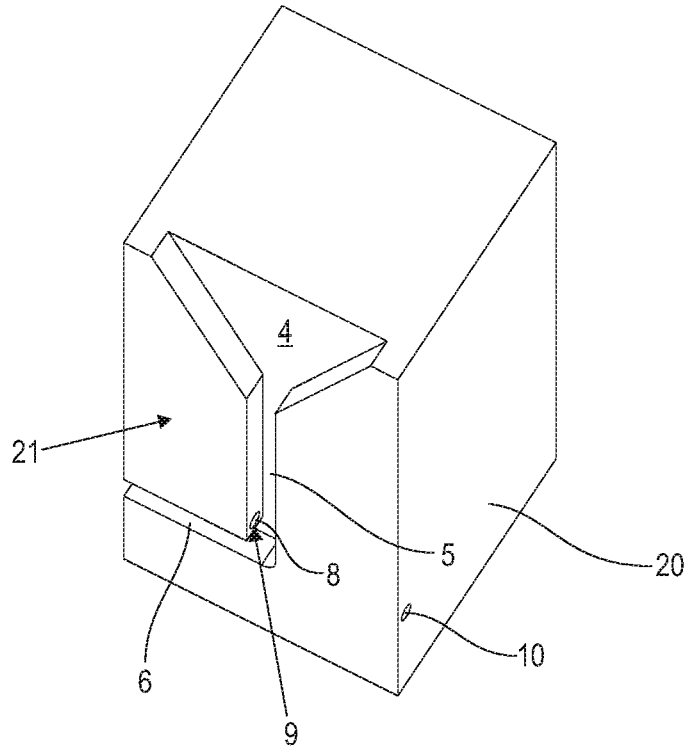
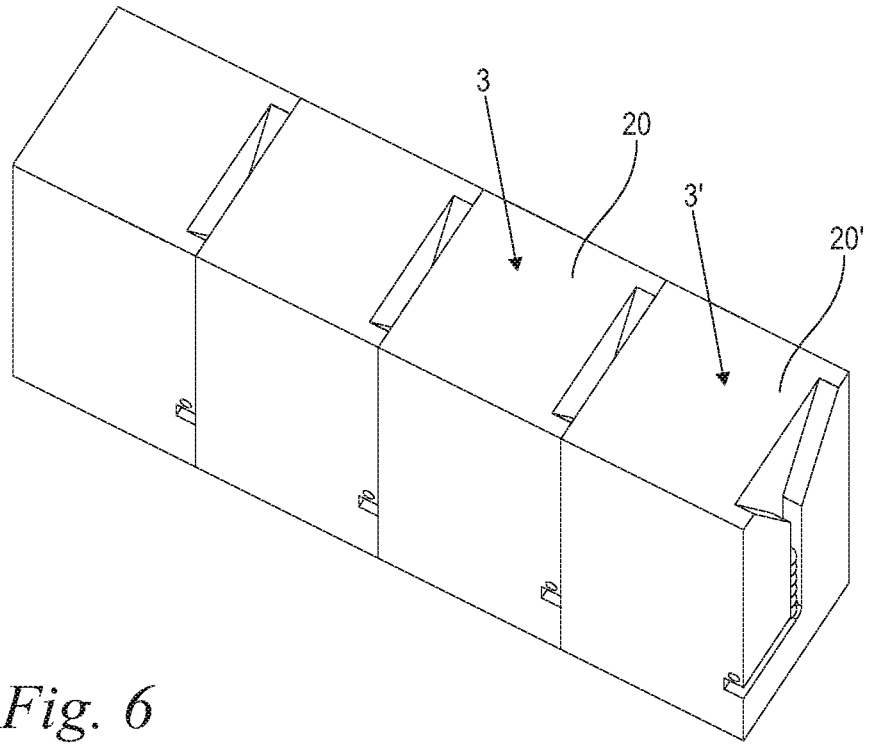
*Fig. 6*

METHOD AND DEVICE FOR SEPARATING AND TRANSFERRING PELLETS

CROSS REFERENCE TO RELATED APPLICATIONS

This application is a continuation application of international patent application PCT/EP2015/001484, filed Jul. 18, 2015, designating the United States and the entire content of which is incorporated herein by reference.

FIELD OF THE INVENTION

The invention relates to a method for separating and for transferring pellets, in particular cryo-pellets, into a target container, and to a singularization device for carrying out this method.

BACKGROUND OF THE INVENTION

Numerous pharmaceutical agents are applied as solutions but are unstable in the dissolved state. However, the pharmaceutical agents as freeze-dried formulations can be stored in a stable manner and be dissolved again immediately prior to being used. Examples thereof to be mentioned are biotechnological products, peptides, vaccines, and certain reagents.

More recently, such formulations are also produced in the form of more or less spherical multi-particular preparations as so-called cryo-pellets. To this end, the source solution is brought into a drop form, wherein drops having an accurately defined volume are producible. These drops are frozen, for example in liquid nitrogen, and are then dried by way of sublimation. The dry cryo-pellets that are produced in this way have at least approximately a spherical configuration having a defined mean diameter. If required, the cryo-pellets can again be dissolved in suitable quantities. The target herein is to produce only such a limited quantity of solution as is required for covering the immediate demand, to which end corresponding quantities of cryo-pellets are kept available in suitable packaging units.

The number of cryo-pellets required for preparing a solution is typically very low. Consequently, only a single pellet or just a few pellets are required which is why a volumetric metering in the filling of respective packaging units is precluded. Rather, a filling of the packaging units with a specific suitable number of pellets is targeted, to which end the pellets in this very number have to be separated from a comparatively large supply and then have to be transferred into the target container. However, the prior art does not provide any suitable method for separating and for transferring and also no device suitable for this purpose, which can be traced back to inter alia the following aspects:

- Cryo-pellets are extremely fragile and sensitive to abrasion. Existing supply technologies (for example slides, vibration infeeds) lead to mechanical damage to the pellets.
- The density of the pellets, being $\rho<0.2$ g/ml, is so minor that the weight of the pellets alone is hardly sufficient for a targeted supply.
- The pellets in the case of frequent contact with one another and with other surfaces have a pronounced tendency toward electrostatic charging, this being critical in particular in the case of a vibration infeed.
- Filling has in most cases to be performed at very low relative humidity or under a protective gas atmosphere.

SUMMARY OF THE INVENTION

It is an object of the invention to provide a method for separating and for transferring pellets into a target container, the method enabling a reliable and economical implementation also in the case of difficult materials such as in the case of cryo-pellets.

This object can, for example, be achieved by a method for separating and transferring pellets into a target container. The method includes the steps of: providing a supply of pellets in a storage space; directing the pellets from the storage space into a metering duct that leads out of the storage space downward and is vertically oriented in such a manner that a column of pellets that lie on top of one another is formed in the metering duct, wherein a lowermost pellet of the column of pellets is located in a connection point, and wherein an outlet duct is connected to the metering duct at the connection point and leads transversely away from the metering duct; impinging a first pressure differential duct, which opens into the metering duct via a first duct mouth above the connection point, with negative pressure, wherein a pellet is suctioned onto the first duct mouth and on account thereof is locationally fixed thereto, and wherein this suctioned pellet acts as a block for the pellets located thereabove; impinging a second pressure differential duct, which opens into the connection point via a second duct mouth, with positive pressure, wherein the pellet that is located in the connection point is pneumatically ejected by way of the outlet duct and supplied to the target container; and, switching off the negative pressure in the first pressure differential duct after the pneumatic ejection of the lowermost pellet such that the pellet that is locationally fixed at the first duct mouth moves on toward the connection point and a new lowermost pellet is located in the connection point.

It is a further object of the invention to provide a singularization device for separating and transferring pellets into a target container.

This object can, for example, be achieved by a singularization device having: a storage space for pellets; a metering duct leading downward from the storage space and being vertically oriented; an outlet duct connected to said metering duct at a connection point and leading transversely away from said metering duct; at least one first pressure differential duct opening into said metering duct above said connection point via a first duct mouth; a second pressure differential duct opening into said connection point via a second duct mouth; said first pressure differential duct being configured to be impinged with negative pressure; said second pressure differential duct being configured to be impinged with positive pressure; a negative pressure source configured to impinge said first pressure differential duct with negative pressure so as to cause a pellet to be suctioned onto said first duct mouth and become locationally fixed thereat so as to act as a block for pellets located thereabove; a positive pressure source configured to impinge said second pressure differential duct with positive pressure so as to pneumatically eject a lowermost pellet located at said connection point via said outlet duct and to supply the pellet to a target container; and, said negative pressure source being configured to cease impinging said first pressure differential duct with negative pressure after the pneumatic ejection of the lowermost pellet so as to cause the pellet locationally fixed at said first duct mouth to move toward said connection point.

Initially a supply of pellets is provided in a storage space. The pellets are then directed in such a manner from the storage space into a metering duct that leads out of the storage space downward and is vertically oriented, that a column of pellets that lie on top of one another is formed in the metering duct. The lowermost pellet of this column of pellets is located in a connection point, wherein an outlet duct is connected to the metering duct at the connection point and leads transversely away from the metering duct. A first pressure differential duct which via a first duct mouth above the connection point opens into the metering duct is impinged with negative pressure, wherein a pellet is suctioned onto the first duct mouth and is consequently locationally fixed thereto. This suctioned pellet herein acts as a block for the pellets that are located thereabove.

Proceeding therefrom, a second pressure differential duct, which via a second duct mouth opens into the connection point, is impinged with positive pressure wherein the pellet that is located in the connection point is pneumatically ejected by way of the outlet duct and supplied to the target container. After the pneumatic ejection of the lowermost pellet the holding negative pressure in the first upper pressure differential duct is switched off such that the pellet that is held at the first duct mouth moves on toward the connection point and a new lowermost pellet is located in the connection point.

By way of a method according to the invention that has been described above, and by way of the associated device, one or a plurality of pellets can be separated from the enlarged pellet supply and be supplied to the target container, wherein separating as well as supplying is performed solely by the targeted application of negative pressure and positive pressure. The mechanical action on the pellets is very minor on account of the purely pneumatic handling. Even mechanically critical pellets such as cryo-pellets can be reliably handled without mechanical damage to the pellets, such as abrasion or the like, is to be noted. The density of the pellets that is insufficient for a conveyance by weight, proves to be an advantage because suctioning and fixing the pellets, as well as the transportation by pneumatic ejection, function similarly effectively in the case of the typically very low material densities herein. Friction and other mechanical effects are reduced to a minimum such that electrostatic charging or the possible effects thereof, respectively, are largely avoided or are negligible, respectively.

The first and the second duct mouth are mutually disposed at a height differential. In an advantageous embodiment of the singularization device, the height differential is an integral multiple of a mean diameter of the pellets. It is ensured on account thereof that a defined number of pellets is collected below that pellet that acts as a block, the defined number being precisely blown into the target container. The integral multiple can be two, three, four, or more, and predefines the number of the pellets that are to be in each case pneumatically ejected into one target container. In an advantageous embodiment the integral multiple is one, as a consequence of which exactly one pellet is pneumatically ejected with each work cycle. However, this does not necessarily mean that also exactly only one pellet is supplied to the target container. Rather, a specific number of individual pellets can be blown into the target container by way of a specific number of cycles, on account of which a high reliability in terms of the process is provided.

In order to be able to vary the number of the pellets to be exhausted, an embodiment of the singularization device in which a plurality of first pressure differential ducts via the first duct mouths assigned thereto open into the metering duct can also be expedient. Depending on requirements, in this instance a duct mouth that is positioned so as to be more or less higher can be activated by way of negative pressure and serve as a block, wherein in this instance, depending on the chosen position in terms of height, a more or less large number of pellets are collected therebelow and ejected into the target container.

In all cases, the separation of a specific number of pellets is based on the fact that negative pressure is built up in the first upper pressure differential duct, as a consequence of which a pellet is suctioned and retained at the assigned first duct mouth, wherein this suctioned and retained pellet acts as a block for the pellets that are located thereabove. It is achieved on account thereof that the one or the plurality of pellets that are collected therebelow can be exhausted in the envisaged number without further pellets prematurely moving on from above and falsifying the previously separated quantity.

Various types of handling can be considered for the pellets that are collected below the blocking pellet. For example, it can be sufficient for the lowermost pellet to simply stand on the base of the transversely running outlet duct and to herein lie in the effective range of the second pressure differential duct. As soon as a pulse of compressed air is exhausted by way of this second pressure differential duct, the pellet and optionally also the following pellets are conjointly carried to the target container by the compressed air or the compressed gas. However, in an advantageous embodiment, the lowermost pellet is not simply left to stand on the base. Rather, the lowermost pellet prior to the pneumatic ejection is suctioned onto the second duct mouth because the second pressure differential duct is temporarily impinged with negative pressure. On account thereof, above all while considering the effective minor weights, reliable replenishing of the pellets from top to bottom is facilitated. Moreover, the lowermost pellet is reliably fixed by way of a suction force to the duct mouth of the lower pressure differential duct, the lowermost pellet on account thereof being positioned in a locationally accurate manner. This facilitates an accurate counting process as well as a later exhausting procedure that is reproducible.

Various temporal profiles can be considered for suctioning the pellets onto the two duct mouths. However, the suctioning of the pellet that acts as the block onto the first duct mouth, and the suctioning of the lowermost pellet onto the second duct mouth is preferably performed in a temporally alternating manner. Temporal overlaps are indeed permitted herein. However, in any case, it should be ensured that there are time frames in which only one of the two pressure differential ducts is impinged with negative pressure. It is ensured on account thereof that the suctioning onto one of the two duct mouths is not influenced in a disadvantageous manner by suctioning onto the respective other duct mouth.

As soon as the desired number of pellets has been exhausted, a corresponding number of pellets has to move on from above. To this end, the holding negative pressure in the first pressure differential duct is switched off. It can be sufficient for the ambient pressure or a slight but no longer holding negative pressure to remain in this instance. In an advantageous embodiment, the first pressure differential duct is impinged in the sense of a gas pulse with positive pressure at least briefly. A downward movement of the pellet that is initially held on the first duct mouth is supported or facilitated, respectively, even in the case of a very slight positive pressure.

It can be sufficient for the entire process management to be carried out with air as a pressure and negative medium. A protective gas is expediently used for sensitive pellets such as cryo-pellets, wherein such a protective gas is advantageously introduced into the metering duct or into the outlet duct, respectively in the case of an impingement of the first and/or of the second pressure differential duct by positive pressure. It is considered on account thereof that cryo-pellets are typically extremely hygroscopic. Moreover, the protective gas can serve for rendering the pellets inert.

Pressure monitoring and/or flow-rate monitoring of the first and/or of the second pressure differential duct is preferably performed in an advantageous embodiment. Disturbances in the process can be identified, and counter measures can be initiated, by identifying irregularities in the profile of the pressure or the flowrate, respectively.

Overall, the method that is conceived so as to be simple, in a corresponding manner also requires a singularization device that is also conceived so as to be simple, wherein the substantial elements in the form of ducts and the like can be readily incorporated into a main body. This permits a plurality of singularization devices to be interconnected in the manner of modules and therefore to be able to be constructed in a flexible manner in the desired number and configuration. It can be expedient for the required ducts and the like to be configured as bores in such a main body. However, in one preferred variant, the storage space, the metering duct, the outlet duct, the first pressure differential duct, and/or the second pressure differential duct are/is incorporated into the surface of such a main body, and are/is closed by the main body of the neighboring singularization device. The production effort is minimized on account thereof, on the one hand. On the other hand, ready accessibility to all ducts can be achieved by way of disassembly, such that disturbances of any type can be readily remedied.

Depending on requirements, it can be expedient for cuboid-shaped main bodies to be interconnected in a linear sequence. Alternatively, it can be expedient for main bodies that in the footprint are shaped as circular segments to be interconnected in the shape of a circle or in the shape of circular segments, such that overall compact systems of a plurality of singularization devices are constructed, and wherein such individual main bodies can be replaced, removed, or added in a modular manner.

BRIEF DESCRIPTION OF THE DRAWINGS

The invention will now be described with reference to the drawings wherein:

FIG. 2 shows the arrangement as per FIG. 1 when ejecting the lower pellet in the case of a simultaneously suctioned and fixed upper pellet;

FIG. 3 shows the arrangement as per FIGS. 1 and 2 when transferring the upper pellet to the lower duct mouth;

FIG. 5 in a perspective view shows a cuboid-shaped main body for forming the singularization device as per FIGS. 1 to 3, wherein a storage space, the metering duct, the outlet duct, the first pressure differential duct, and the second pressure differential duct are incorporated into the surface of the main body;

FIG. 6 in a perspective view shows an embodiment in which a plurality of cuboid-shaped main bodies as per FIG. 5 are positioned so as to be mutually adjacent in a linear sequence, forming a linear sequence of a plurality of singularization devices;

DESCRIPTION OF THE PREFERRED EMBODIMENTS OF THE INVENTION

Figure 1:
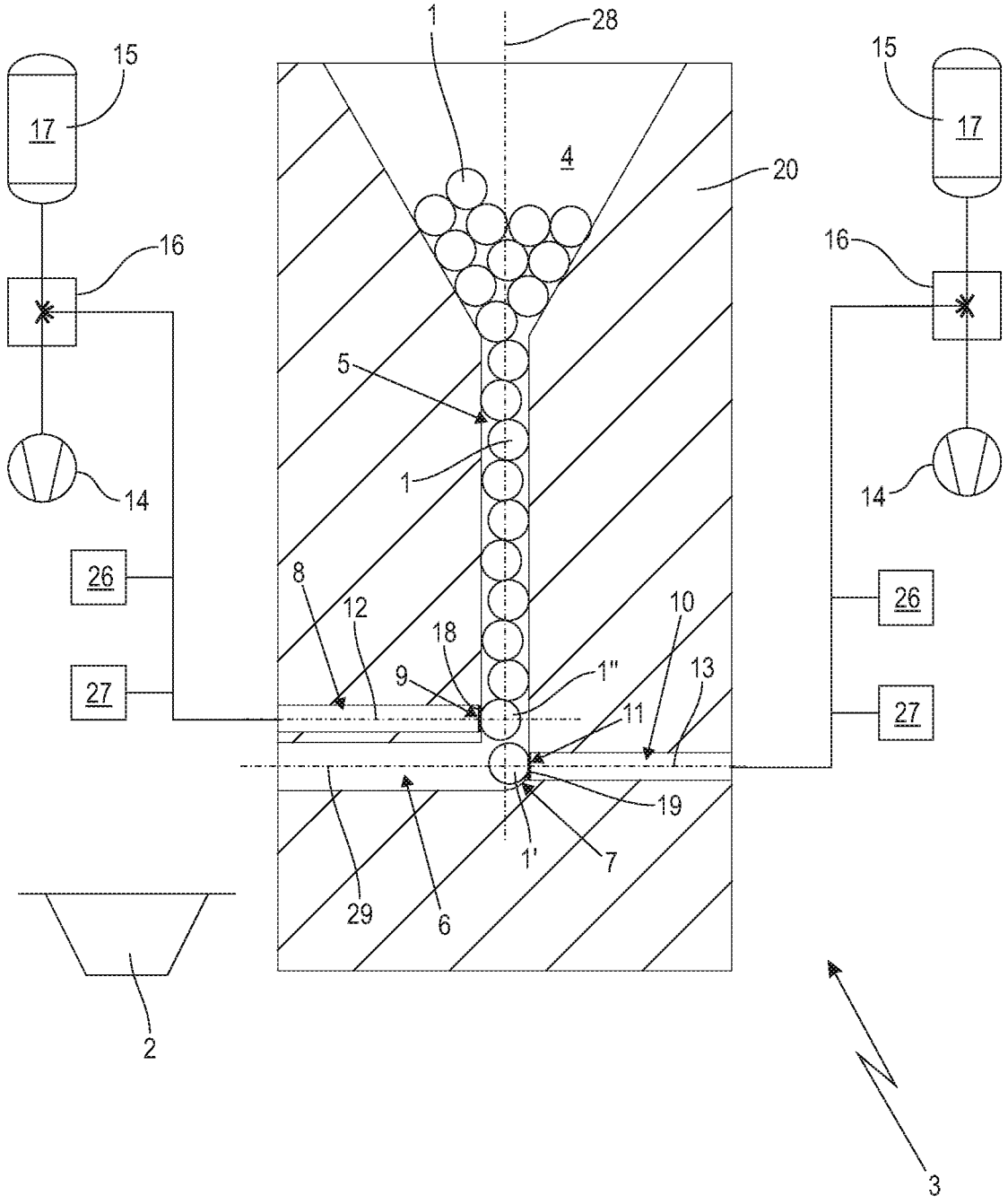
FIG. 1 in a schematic sectional illustration shows a first embodiment of a singularization device for separating cryo-pellets from a comparatively large supply and for transferring the separated pellets into a target container via a vertically oriented metering duct, of an outlet duct that runs transversely to the latter, and of two pressure differential ducts, wherein in each case one pellet is suctioned at and fixed to the duct mouths of both pressure differential ducts.

FIG. 1 in a schematic sectional illustration shows a first embodiment of a singularization device 3 for transferring pellets 1, 1', 1", into a schematically indicated target container 2. The singularization device 3 shown here and the method, described hereunder and carried out by the singularization device 3, are suitable for separating and transferring almost any desired pellets, wherein the cryo-pellets that are particularly critical in terms of handling are the main focus and serve as examples for the pellets 1, 1', 1". The singularization device 3 includes a storage space 4 for the pellets 1 and a metering duct 5 that leads out of the storage space 4 downward and is vertically oriented. The storage space 4 here is configured as a funnel which in relation to the direction of weight tapers off in a downward manner into the metering duct 5. The vertical orientation of the metering duct 5 does not necessarily mean a precisely vertical alignment. An inclined embodiment in which in any case a significant vertical extent is present in portions can also be expedient. A first longitudinal axis 28 of the metering duct 5, which in the usual operating position in the embodiment shown does indeed lie parallel with the direction of weight but in relation to the direction of weight can also have an inclination of not more than 45° and in particular of not more than 30°, serves as a yardstick.

The singularization device 3 moreover includes at least one, presently exactly one, first pressure differential duct 8, and a second pressure differential duct 10. The first pressure differential duct 8 via a first duct mouth 9 above the connection point 7 opens into the metering duct 5. The second pressure differential duct 10 by way of a second duct mouth 11 above the first duct mouth 9 opens into the connection point 7. The first pressure differential duct 8 has a first duct axis 12, while the second pressure differential duct 10 has a second duct axis 13. The first duct axis 12 in the region of the associated duct mouth 9 lies transversely to the first longitudinal axis 28 of the metering duct 5, while the second duct axis 13 of the second pressure differential duct 10 in the region of the associated duct mouth 11 runs substantially parallel, presently even so as to be coaxial, with the second longitudinal axis 29 of the outlet duct 6. The two pressure differential ducts 8, 10 at the assigned duct mouths 9, 11 thereof are provided in each case with one retention means 18, 19 that prevents any ingress of foreign particles and in particular of the pellets 1, 1', 1" into the respective pressure differential ducts 8, 10. However, at the same time, the retention means 18, 19 are gas-permeable.

Filter materials with fine pores, such as sintered filters, membrane filters, or the like are suitable therefor.

In order for the method to be carried out, it is necessary for the first, upper pressure differential duct 8 to be able to be impinged with negative pressure when required, while the second, lower pressure differential duct 10 is to be able to be impinged with positive pressure when required. However, in the embodiment shown, both pressure differential ducts 8, 10 are impingable in an alternating manner with negative pressure or else with positive pressure. To this end, in each case one negative pressure source 14 as well as in each case also one positive pressure source 15 are provided for both pressure differential ducts 8, 10, wherein the first pressure differential duct 8, or the second pressure differential duct 10, respectively, via a respective assigned switching valve 16 can be selectively connected to the associated negative pressure source 14 or to the associated positive pressure source 15. Of course, a position of the respective switching valve 16 in which the ambient pressure is set in the respective pressure differential duct 8, 10 is also possible. The operation of the singularization device 3 shown can be performed at atmospheric conditions, wherein compressed air via the negative pressure source 14 is fed into the system by way of the respective pressure differential duct 8, 10. Protective gas containers 17 in which protective gas is kept available under positive pressure are provided as positive pressure sources 15 in the embodiment shown. In the context of individual method steps that are described further below, the pressurized protective gas via the first pressure differential duct 8 and/or of the second pressure differential duct 10 is directed from the respective protective gas container 17 through the respectively assigned duct mouth 9, 11 into the metering duct 5 or into the outlet duct 6, respectively. In the interests of simplicity two protective gas containers 17 are drawn in according to FIG. 1. However, it can also be expedient to feed both pressure differential ducts 8, 10 from a collective protective gas container 17.

According to an advantageous embodiment of the method, according to FIG. 1 a comparatively large supply of a plurality of pellets 1 is first provided in the storage space 4. The pellets 1 together with the singularization device 3 form an inherently tuned system according to which the available passage cross section of the metering duct 5 as well as the available passage cross-section of the outlet duct 6 are slightly larger than a mean diameter D (FIG. 2) of the pellets 1. In a more exact definition, the passage cross-section in particular of the vertically standing metering duct 5 is larger than the mean diameter D (FIG. 2) by so much that the pellets 1 can indeed pass in an unimpeded manner from the top to the bottom through the metering duct 5 without however, on the other hand, two pellets being allowed to pass simultaneously beside one another. Rather, the available passage cross-section of the metering duct 5 is dimensioned in such a manner that the pellets 1 drop from the storage space 4 downward into the metering duct 5, thereby forming a column of pellets 1, 1', 1" that lie on top of one another. As part of this column, a lowermost pellet 1' in the initial position shown in FIG. 1 is located in the connection point 7 of the outlet duct 6 with the metering duct 5. It can be expedient herein for the lowermost pellet 1' to stand on the base of the outlet duct 6. In the embodiment shown, the second pressure differential duct 10 is initially impinged with negative pressure in that the second pressure differential duct 10 via the assigned switching valve 16 is connected to the associated negative pressure source 14. Consequently, the lowermost pellet 1' is suctioned onto the second duct mouth 11 and pressed against the retention means 19, on account of which the lowermost pellet 1' is held in position.

In the initial position mentioned according to FIG. 1, the first, upper pressure differential duct 8 is also simultaneously impinged with negative pressure, to which end the first pressure differential duct 8 likewise via the switching valve 16 thereof is connected to the associated negative pressure source 14 of the pressure differential duct 8. Consequently, that pellet 1" that is closest to the assigned duct mouth 9 is suctioned from the column of pellets 1. This pellet 1" is pressed against the retention means 18 and herein is locationally fixed as long as the holding negative pressure is maintained in the upper pressure differential duct 8. It is prevented on account thereof that the suctioned pellet 1 slips downward into the connection point 7, on the one hand. On the other hand, the suctioned pellet" acts as a block for the pellets 1 located thereabove and consequently prevents the latter from moving on downward.

In the combined view of FIGS. 1 and 2 it also becomes evident that the first duct mouth 9 of the first, upper pressure differential duct 8 is positioned above the second duct mouth 11 of the second, lower pressure differential duct 10 by way of a height differential ΔH. This height differential ΔH is at least approximately an integral multiple of the mean diameter D of the pellets 1. It will become evident further below that a mathematically exact adherence to the integral multiple is not crucial, this here being expressed by way of the terminology "at least approximately". In any case, this integral multiple in the embodiment as per FIGS. 1 to 3 within the context of specific tolerances is one. The latter and the adherence to the tolerances mentioned leads to only space for exactly one lowermost pellet 1 to remain below the pellet 1" that has been suctioned onto the upper duct mouth 9 and acts as a block. In an analogous manner thereto, in the case of a larger integral multiple, there remains space for a corresponding number of lower pellets 1' below the mentioned pellet 1" that acts as a block. The latter case is illustrated in an exemplary manner in FIG. 4; this is to be discussed in yet more detail further below.

FIGS. 2 and 3 in fragments show the arrangement as per FIG. 1 when the following method steps are being carried out. Proceeding from the initial position as per FIG. 1, exhausting those lower pellets 1' which are collected below the pellet 1" that acts as a block and is fixed to the first duct mouth 9 is performed in the next method step. This method step is shown in the schematic sectional illustration as per FIG. 2. To this end, the second pressure differential duct 10 is impinged with positive pressure over a defined period of time, to which end the second pressure differential duct 10 via the assigned switching valve 16 is connected to the positive pressure source 15 that is assigned to the second pressure differential duct 10. A gas pulse, as a consequence of which gas is blown according to an arrow 22 through the duct mouth 11 into the outlet duct 6 along the axis 29 thereof, is created in the lower pressure differential duct 10. The blown-in gas according to an arrow 23 carries the lowermost pellet 1' that previously was suctioned at the lower duct mouth 11 through the outlet duct 6 into the provided target container 2. A single gas pulse is typically sufficient for exhausting a single lower pellet 1' or a plurality of lower pellets 1' that have been simultaneously collected. In the case of a plurality of lower pellets 1' having been separated below the pellet 1" that serves as a block, exhausting can alternatively also be performed by way of a corresponding number of gas pulses. In any case, the upper, first pressure differential duct 8 during exhausting is impinged with the holding negative pressure that has been described above such that the pellet 1" that serves as a block as well as all pellets 1 that are located thereabove remain in place despite the pressure pulse that has been initiated below. The pellets 1 are thus neither blown back into the storage space 4 nor are the pellets 1 able to prematurely move on downward into the connection point 7 that in the meantime has been vacated.

Once the one or the plurality of lower pellets 1' have been exhausted according to FIG. 2, the next method step is carried out according to FIG. 3. The holding negative pressure in the first pressure differential duct 8 is switched off such that the pellet 1" that is held on the first duct mouth 11 (FIG. 2) moves on toward the connection point 7, a new lowermost pellet 1' (FIG. 3) being located in the connection point 7. This replenishment can take place solely as a result of the acting weights. To this end, the lower, second pressure differential duct 10 in the embodiment shown is again impinged with negative pressure, on account of which the respective lowermost pellet 1' prior to being exhausted later is suctioned onto the second duct mouth 11. The transfer of pellets from the upper, first duct mouth 9 to the lower, second duct mouth 11 according to an arrow 25, as has been described above, can also yet be supported in that the first pressure differential duct 8 is briefly impinged with positive pressure in that the first pressure differential duct 8 via the assigned switching valve 16 thereof is connected to the assigned positive pressure source 15. On account thereof, a pressure pulse, via which gas according to an arrow 24 is introduced through the duct mouth 9 into the metering duct 5, thereby supporting the moving-on according to the arrow 25 of the pellet 1" that has previously been held on the first duct mouth 9 (FIG. 2), is formed. This positive pressure pulse simultaneously prevents premature moving-on in a downward manner of the column of pellets 1 that is located thereabove.

Air or compressed air, respectively, can be used as the process and positive pressure medium. To the extent that a protective gas container 17 is provided as a positive pressure source 15 according to the embodiment as per FIGS. 1 to 3, the protective gas in the case of the pressure pulses that have been described above is introduced from the respective protective gas container 17 through the first and/or the second pressure differential duct 8, 10 into the metering duct 5 or into the outlet duct 6, respectively. On account thereof, a protective gas atmosphere can be maintained in all regions of the singularization device that interact with the pellets 1, 1', 1". This permits the handling of cryo-pellets that are extremely hygroscopic and, when required, also enables the pellets 1, 1', 1" to be rendered inert.

The impingement of the two pressure differential ducts 8, 10 with negative pressure can be mutually overlapping to a certain extent. However, suctioning of the pellet 1" that acts as a block onto the first duct mouth 9, and suctioning of the lowermost pellet 1' onto the second duct mouth 11, is advantageously performed in a temporally alternating manner such that the holding negative pressure on the upper duct mouth 9 is at least temporarily switched off when the transfer and the moving-on of the lowermost pellet 1' are performed via negative pressure at the lower, second duct mouth 11. In any case, the temporary negative pressure in the lower, second pressure differential duct 10 also supports the moving-on of the pellets 1 from the target container 2 into the metering duct 5. This can also be utilized for the initial filling of the metering duct 5 with pellets 1, 1', 1" for achieving the initial position as per FIG. 1.

Subsequently to the method step according to FIG. 3, the upper, first pressure differential duct 8 is again impinged with negative pressure, on account of which a new pellet 1" that serves as a block is consequently suctioned and fixed. The initial position as per FIG. 1 is reestablished, and the previously described method cycle can restart.

It can also be derived from the illustration as per FIG. 1 that monitoring means which presently in an exemplary manner are configured as a pressure sensor 26 and/or as a flow rate sensor 27 and are connected to a suitable monitoring unit (not illustrated here for the sake of simplicity) are disposed in the region of the first and/or the second pressure differential duct 8, 10. On account thereof, pressure monitoring and/or rate flow monitoring can be performed and errors in the method sequence can be identified.

Figure 4:
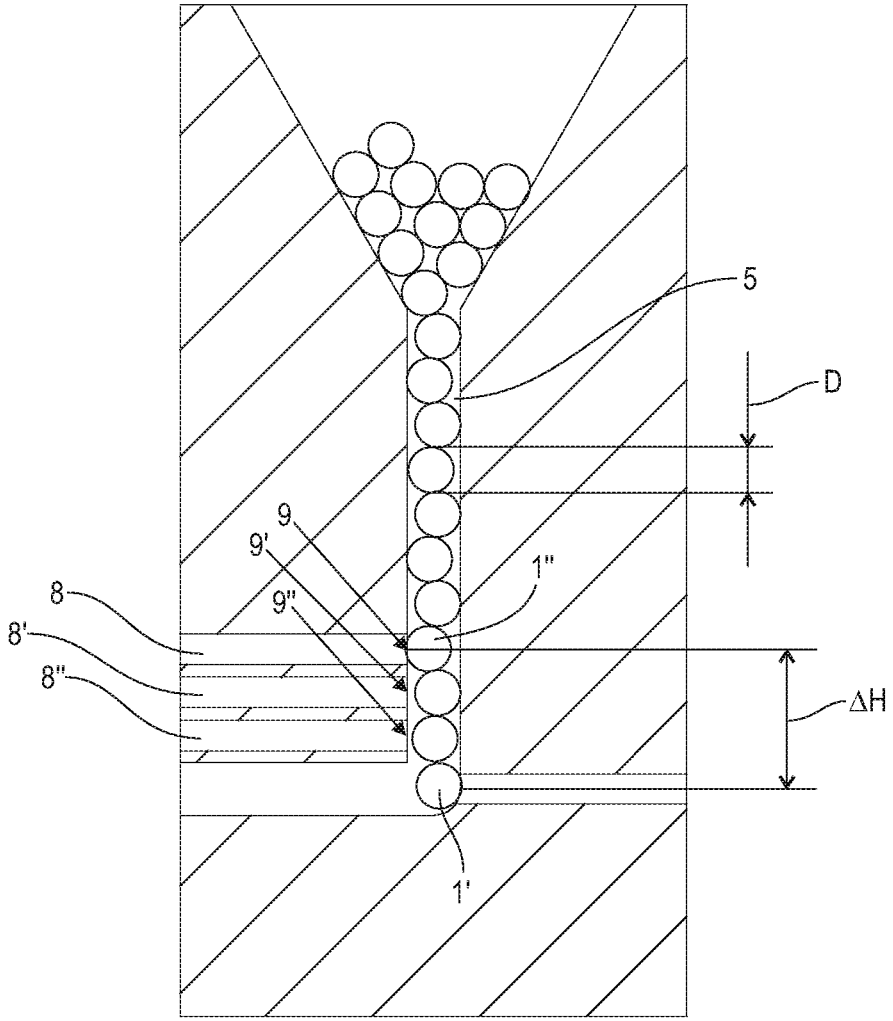
FIG. 4 shows a variant of the arrangement as per FIGS. 1 to 3, having a plurality of upper pressure differential ducts, presently in an exemplary manner three upper pressure differential ducts, for the simultaneous separation of a plurality of pellets.

FIG. 4 in a schematic sectional illustration shows a variant of the arrangement as per FIGS. 1 to 3, wherein a plurality of, in an exemplary manner presently three, first pressure differential ducts 8, 8', 8" via the first duct mouths 9, 9', 9" assigned thereto open into the metering duct 5. The height differential between the individual duct mouths 9, 9', 9" here is again an integral multiple of the mean diameter D of the pellets 1, wherein the integral multiple here is 1. The uppermost first duct mouth 9 thus is at a height differential $\Delta H$ above the second duct mouth 11, wherein, in a manner analogous to that of the embodiment as per FIGS. 1 to 3, this height differential $\Delta H$ is at least approximately an integral multiple of the mean diameter D. This integral multiple in the embodiment shown is 3. To the extent of the uppermost of the plurality of first pressure differential ducts 8, 8', 8", presently thus the pressure differential duct 8, thus being impinged with negative pressure, a block by way of an adhering or suctioned pellet 1", respectively, is configured at the assigned duct mouth 9, exactly three lower pellets 1' being collected therebelow and according to the method sequence as per FIGS. 1 to 3 being exhausted into the respective target container 2. Depending on requirements, however, one of the other first pressure differential ducts 8', 8" can also be impinged with negative pressure, this then resulting in a separation of precisely one or precisely two lower pellets 1'. Of course, the same applies in an analogous manner also to a deviating number or positioning of first duct mouths 9, 9', 9". In terms of the remaining features and reference signs as well as also method steps, the embodiment as per FIG. 4 is identical to that of FIGS. 1 to 3.

FIG. 5 in a perspective view shows a cuboid-shaped main body 20 for forming an individual singularization device 3 as per FIGS. 1 to 3, and 6. It can be expedient for bores, openings, or the like, to be incorporated into such a main body 20 so as to configure therewith the various ducts as described above. The two pressure differential ducts 8, 10 in the embodiment shown are formed by two such bores. Deviating therefrom, the storage space 4, the metering duct 5, and the outlet duct 6 are machined as a duct-type depression into a surface 21 of the main body 20, the depressions initially being open to the outside. However, it can also be expedient for the two pressure differential ducts 8, 10 or another part of the aforementioned elements, to be additionally configured in this one surface 21. According to the perspective illustration as per FIG. 6, a plurality of such main bodies 20 can be interconnected in a linear sequence, wherein the duct-type depressions mentioned in a main body 20 are closed by the neighboring main body 20', and on account of which singularization devices 3, 3' that are interconnected in the manner of modules are formed.

Figure 8:
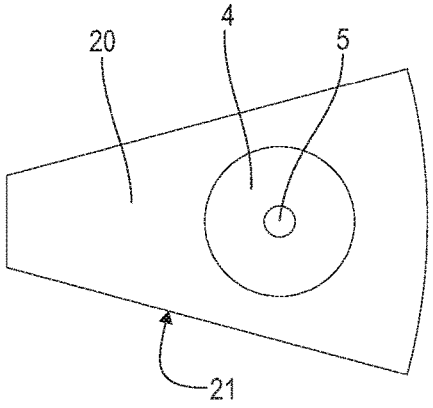
FIG. 8 in a plan view shows the main body as per FIG. 7, having a circular-segment-shaped footprint; and, FIG. 9 in a perspective view from below shows a group of a plurality of main bodies as per FIGS. 7 and 8, arranged in a circular shape.

Deviating therefrom, FIG. 8 shows a main body 20 in a plan view, the footprint of the main body 20 being in the shape of a circular segment. Here too, the various ducts can be configured on a lateral surface 21 in a manner analogous to that of FIG. 5. However, in an exemplary manner, the storage space 4, the metering duct 5, and also the other elements, are machined so as to be centric in the main body 20.

Figure 9:
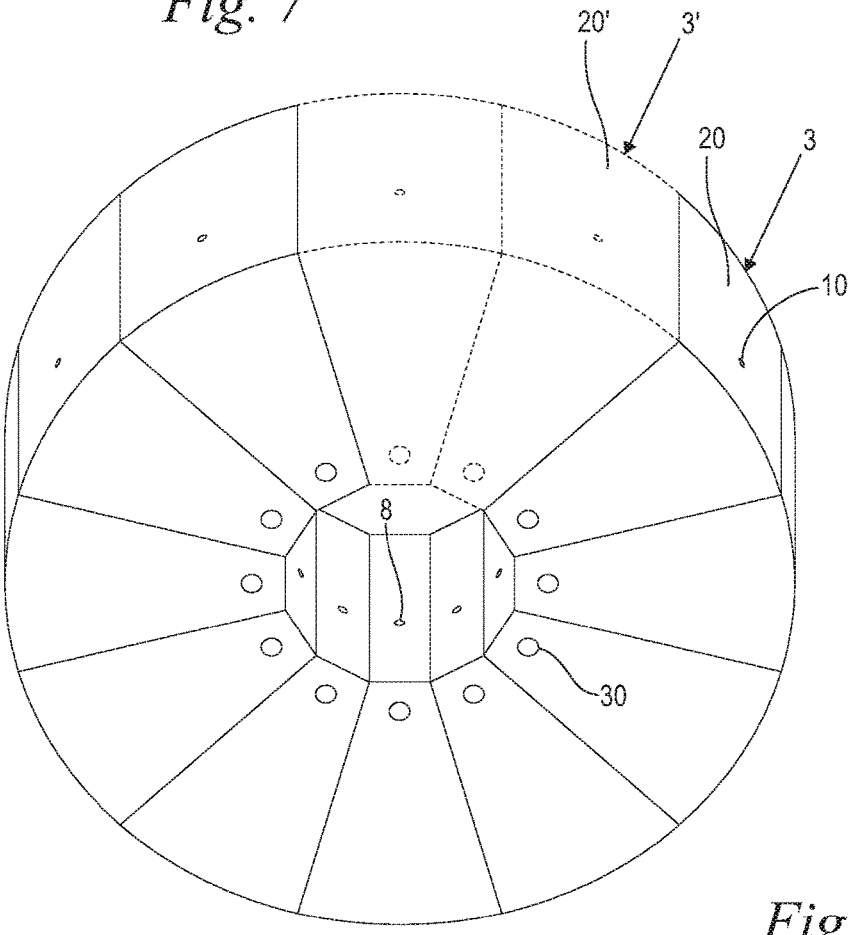

FIG. 9 in a perspective view from below shows a group of a plurality of main bodies 20, 20' as per FIG. 8, the main bodies 20, 20' being interconnected in the manner of modules so as to be mutually adjacent and, by virtue of the shape of a circular segment of an individual main body 20 overall forming a group of singularization devices 3, 3' that is disposed in the shape of a circle. Of course, individual singularization devices 3' which presently for the sake of simplicity are only illustrated in dashed lines can also be omitted, on account of which the overall shape of a circular segment of the group of singularization devices 3 results.

It can also be derived from the perspective illustration as per FIG. 9 that little space in the radially inward region remains of the circular or circular-segment shape chosen. In consideration thereof, exit openings 30 of the outlet ducts 6 (FIG. 7) are disposed on the lower side of the main bodies 20. Details thereof are derived from the schematic sectional illustration of the main body 20 as per FIG. 7. In a manner deviating from the embodiment as per FIG. 1, only that part of the outlet duct 6 that is directly adjacent to the connection point 7 runs transversely to the metering duct 5, or transversely to the direction of weight, respectively, while a duct segment 6' of the outlet duct 6 that is adjacent thereto is angled in a downward manner and via the lower exit opening 30 leads to the target container 2 that is positioned therebelow.

Figure 7:
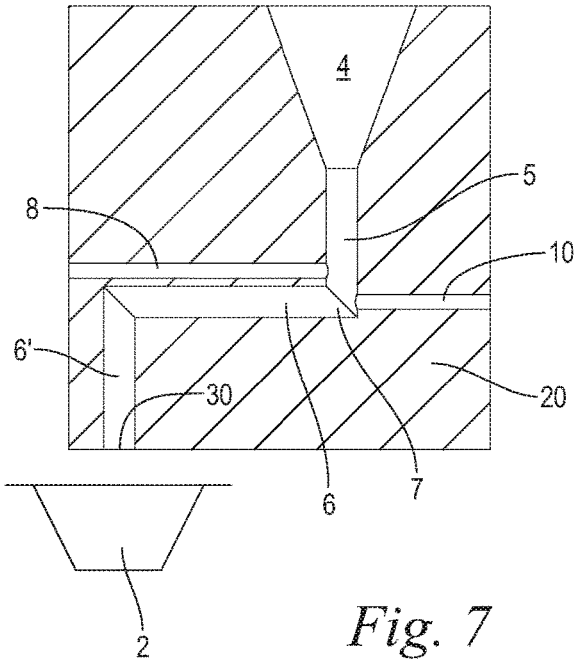
FIG. 7 in a sectional illustration shows a variant of the embodiment as per FIG. 1, having an outlet duct that discharges downward.

In as far as not explicitly described or illustrated in the drawings so as to deviate therefrom, the embodiments as per FIGS. 5 and 6 and as per FIGS. 7 to 9 in terms of the remaining features and reference signs are mutually identical as well as identical to the embodiment as per FIGS. 1 to 3. The same also applies to the assigned method steps. Apart therefrom, features of the one embodiment can also be linked to a respective other embodiment.

It is understood that the foregoing description is that of the preferred embodiments of the invention and that various changes and modifications may be made thereto without departing from the spirit and scope of the invention as defined in the appended claims.

What is claimed is:

1. A method for separating and transferring pellets into a target container, the method comprising the steps of:

providing a supply of pellets in a storage space;

directing the pellets from the storage space into a metering duct that leads out of the storage space downward and is vertically oriented in such a manner that a column of pellets that lie on top of one another is formed in the metering duct, wherein a lowermost pellet of the column of pellets is located in a connection point, and wherein an outlet duct is connected to the metering duct at the connection point and leads transversely away from the metering duct;

impinging a first pressure differential duct, which opens into the metering duct via a first duct mouth above the connection point, with negative pressure, wherein a pellet is suctioned onto the first duct mouth and on account thereof is locationally fixed thereto, and wherein this suctioned pellet acts as a block for the pellets located thereabove;

impinging a second pressure differential duct, which opens into the connection point via a second duct mouth, with positive pressure, wherein the pellet that is located in the connection point is pneumatically ejected by way of the outlet duct and supplied to the target container;

switching off the negative pressure in the first pressure differential duct after the pneumatic ejection of the lowermost pellet such that the pellet that is locationally fixed at the first duct mouth moves on toward the connection point and a new lowermost pellet is located in the connection point;

impinging the second pressure differential duct with negative pressure so as to cause the lowermost pellet to be suctioned onto the second duct mouth prior to the pneumatic ejection; and, wherein the suctioning of the pellet that acts as a block onto the first duct mouth and the suctioning of the lowermost pellet onto the second duct mouth are performed in a temporally alternating manner.

2. The method of claim 1 further comprising the step of impinging the first pressure differential duct with positive pressure for facilitating the advancement of the pellet held at the first duct mouth.

3. The method of claim 1, wherein, in the case of an impingement of at least one of the first pressure differential duct and the second pressure differential duct by positive pressure, a protective gas is directed into the corresponding one of the metering duct and the outlet duct.

4. The method of claim 1 further comprising the step of monitoring a pressure in at least one of the first pressure differential duct and the second pressure differential duct.

5. A method for separating and transferring pellets into a target container, the method comprising the steps of:

providing a supply of pellets in a storage space;

directing the pellets from the storage space into a metering duct that leads out of the storage space downward and is vertically oriented in such a manner that a column of pellets that lie on top of one another is formed in the metering duct, wherein a lowermost pellet of the column of pellets is located in a connection point, and wherein an outlet duct is connected to the metering duct at the connection point and leads transversely away from the metering duct;

impinging a first pressure differential duct, which opens into the metering duct via a first duct mouth above the connection point, with negative pressure, wherein a pellet is suctioned onto the first duct mouth and on account thereof is locationally fixed thereto, and wherein this suctioned pellet acts as a block for the pellets located thereabove;

impinging a second pressure differential duct, which opens into the connection point via a second duct mouth, with positive pressure, wherein the pellet that is located in the connection point is pneumatically ejected by way of the outlet duct and supplied to the target container;

switching off the negative pressure in the first pressure differential duct after the pneumatic ejection of the lowermost pellet such that the pellet that is locationally fixed at the first duct mouth moves on toward the connection point and a new lowermost pellet is located in the connection point; and, monitoring a flow rate in at least one of the first pressure differential duct and the second pressure differential duct.

6. The method of claim 5 further comprising the steps of:

monitoring a pressure in at least one of the first pressure differential duct and the second pressure differential duct; and, monitoring a flow rate in at least one of the first pressure differential duct and the second pressure differential duct.

7. A method for separating and transferring pellets into a target container, the method comprising the steps of:

providing a supply of pellets in a storage space;

directing the pellets from the storage space into a metering duct that leads out of the storage space downward and is vertically oriented in such a manner that a column of pellets that lie on top of one another is formed in the metering duct, wherein a lowermost pellet of the column of pellets is located in a connection point, and wherein an outlet duct is connected to the metering duct at the connection point and leads transversely away from the metering duct;

impinging a first pressure differential duct, which opens into the metering duct via a first duct mouth above the connection point, with negative pressure, wherein a pellet is suctioned onto the first duct mouth and on account thereof is locationally fixed thereto, and wherein this suctioned pellet acts as a block for the pellets located thereabove;

impinging a second pressure differential duct, which opens into the connection point via a second duct mouth, with positive pressure, wherein the pellet that is located in the connection point is pneumatically ejected by way of the outlet duct and supplied to the target container;

switching off the negative pressure in the first pressure differential duct after the pneumatic ejection of the lowermost pellet such that the pellet that is locationally fixed at the first duct mouth moves on toward the connection point and a new lowermost pellet is located in the connection point; and, monitoring a pressure in at least one of the first pressure differential duct and the second pressure differential duct.

* * * * *